United States Patent [19]

Krupp et al.

[11] Patent Number: 5,064,581

[45] Date of Patent: Nov. 12, 1991

[54] METHOD OF MAKING ELASTIC CARBON FIBERS

[75] Inventors: Stephen P. Krupp, Lake Jackson, Tex.; Scott L. Gessner, Vancouver, Wash.

[73] Assignee: The Dow Chemical Company, Midland, Mich.

[21] Appl. No.: 907,931

[22] Filed: Sep. 16, 1986

Related U.S. Application Data

[63] Continuation-in-part of Ser. No. 700,231, Feb. 11, 1985, abandoned.

[51] Int. Cl.[5] ..... D01F 9/155

[52] U.S. Cl. ..... 264/29.2; 264/29.6; 264/83; 264/210.3; 264/210.7; 264/210.8; 264/211.11; 264/211.15; 423/447.7

[58] Field of Search ..... 264/29.6, 29.2, 29.7, 264/555, 290.5; 423/447.1, 447.5, 447.6, 447.7

[56] References Cited

U.S. PATENT DOCUMENTS

| | | | |
|---|---|---|---|
| 3,333,926 | 8/1967 | Moyer, Jr. et al. | 423/447.7 |
| 3,427,120 | 2/1969 | Shindo et al. | 423/447.5 |
| 3,529,934 | 9/1970 | Shindo | 423/447.7 |
| 3,627,571 | 12/1971 | Cass et al. | 423/447.5 |
| 3,629,379 | 12/1971 | Otani | 264/29.2 |
| 3,849,332 | 11/1974 | Bailey et al. | 264/29.6 |
| 3,959,448 | 5/1976 | Fuller et al. | 264/29.2 |
| 4,014,725 | 3/1977 | Schulz | 264/29.2 |
| 4,115,527 | 9/1978 | Otani et al. | 264/29.2 |
| 4,138,525 | 2/1979 | Schulz | 264/29.2 |
| 4,197,283 | 4/1980 | Crepaux et al. | 264/29.2 |
| 4,243,512 | 1/1981 | Seo | 423/447.1 |
| 4,283,369 | 8/1981 | Kaji et al. | 422/193 |
| 4,314,981 | 2/1982 | Mlyamori et al. | 264/29.2 |
| 4,346,504 | 8/1982 | Birk et al. | 264/555 |
| 4,351,816 | 9/1928 | Schulz | 264/29.2 |
| 4,356,158 | 10/1982 | Iohikawa et al. | 264/29.2 |
| 4,402,900 | 10/1983 | Berry, Jr. | 264/205 |
| 4,402,928 | 9/1983 | Lewis et al. | 264/29.2 |
| 4,470,960 | 9/1984 | Uemura et al. | 423/447.6 |

FOREIGN PATENT DOCUMENTS

| | | | |
|---|---|---|---|
| 2350769 | 5/1974 | Fed. Rep. of Germany | 423/447.6 |
| 2052112 | 4/1971 | France | 423/447.7 |
| 57-126354 | 6/1982 | Japan . | |
| 57-126356 | 6/1982 | Japan . | |
| 60-126323 | 7/1985 | Japan | 264/29.6 |
| 1320890 | 6/1973 | United Kingdom | 423/447.7 |

OTHER PUBLICATIONS

Kirk-Othmer, Encyclopedia of Chemical Technology, Second Ed., Supplement Volume, John Wiley & Sons, New York, pp. 109-120 (1971).

Kirk-Othmer, Encyclopedia of Chemical Technology, Third Ed., Supplement Volume, John Wiley & Sons, New York, pp. 263-280 (1984).

*Primary Examiner*—Hubert C. Lorin

[57] ABSTRACT

A fiber made of pitch having a percent elongation of about 2 percent or greater is made by melt spinning an optically isotropic pitch to form a fiber typically in the range of about 5 to about 50 microns diameter, treating the fiber with an oxidizing atmosphere, subsequently removing a certain portion of the oxidant thereby reducing the weight of the fiber, with the optional post-treatment step of repetitively stretching in the elastic range short of breakage to increase the percent elongation.

9 Claims, No Drawings

METHOD OF MAKING ELASTIC CARBON FIBERS

BACKGROUND OF THE DISCLOSURE

This disclosure is a continuation in part of U.S. Pat. Application Ser. No. 700,231 filed February 11, 1985, assigned to the assignee of the present disclosure now abandoned.

The foregoing disclosure sets forth a pitch which enables carbon fibers to be made by drawing. The carbon fibers made from the pitch have physical characteristics which are in part described by the foregoing disclosure. Separate from that disclosure, it has been additionally discovered that a carbon fiber made with the pitch set forth in that disclosure can be treated during processing to thereby obtain an elastic fiber.

Elastic fibers, and particularly those made of carbon, find great use and application in various and sundry yarn manufacturing procedures and also in the making of cloth or fabrics from such yarns. Yarn manufacturing equipment involves rough handling of the fibers used to make the yarn, and subsequent processing by other equipment is also rough on the fibers making the yarn and cloth made therefrom. For these reasons, it is very important to have a fiber which is not brittle and which has a minimum measure of elongation. Most yarn manufacturing equipment requires a minimum of about two percent elongation of the individual fibers to enable the machinery to operate properly.

It has been discovered that controllable elongation in carbon fibers is very important to obtaining a suitable fiber, that is, a fiber which can be used by typical yarn and cloth manufacturing equipment. The present fiber qualifies on these important criteria and is thus described as a fiber which is suitable for spinning and weaving. Moreover, the fiber of the present disclosure and the method of manufacture for making the fiber describes a fiber which has a controllably high percent elongation. The physical characteristics of the fiber of this disclosure can be modified over a range by post-manufacture treatment to increase the percent elongation. In such an instance, controllable elongation can be obtained. An important feature of the present disclosure is the provision of a fiber which has a significant elastic range with substantially no plastic range. This defines a fiber which can be relied on to return to its original length after stressing. On return to its original length, it still has approximately the same load-bearing capacity, this capacity being unchanged by virtue of the fact that there is no plastic elongation in the fiber.

With the foregoing in mind, the present disclosure is thus summarized as a method of manufacture of a special fiber and the fiber having specific physical characteristics. The method of manufacture utilizes a pitch of a specific description for melt spinning to form a fiber and subsequent treatment after drawing. The post drawing treatment includes oxidizing, preferably with a chlorine atmosphere for a specified interval. Other oxidants can be used including oxygen or air mixed with $NO_z$ serving as a catalyst. The weight of the fiber is increased by chlorine oxidation preferably to about 20 percent, and within the range of about 15 to about 40 percent. Extent of oxidation is an important process parameter; percent weight gain is a rough estimate of oxidation. The percent increase is different with different oxidants Further oxidation can be evidenced by factors other than percent weight change. After oxidation with a selected oxidant and the subsequent increase in weight, the fiber is then subjected to a heated atmosphere, steadily increased to avoid fiber destruction in a processing step known as dehydrohalogenation. The processing step is labeled differently should a nonhalogenic oxidant be used. This then yields a fiber having a relatively large percent elongation, controllably typically in the range of 2 up to a larger percent. The elongation can be increased thereafter by repetitively stressing the fiber through several cycles (typically 3 to 10) wherein the stress applied is perhaps 25 -75 percent of the tensile strength of the fiber. After stressing, the fiber will evidence an increased percent elongation, typically above 5 percent and perhaps as high as 7 percent. At this juncture, the fiber may still be described as responding as an elastic member having substantially no performance in the plastic range.

DETAILED DESCRIPTION OF THE PREFERRED EMBODIMENT

A specific pitch is used as the feed for manufacture of fibers in accordance with the present disclosure. As set forth in the referenced disclosure, the pitch is characterized by being substantially isotropic, which means that it is essentially free of optically observable anisotropic pitch, having a softening point in the range of about 130° to 300° C., a percent quinoline insoluble content of less than about 1 percent and a Conradson carbon measure of 50 or more. This preferred feed material is used to make fibers by suitable drawdown through the use of equipment well known for fiber spinning. The completed fiber, depending on the mode of operation of the drawing equipment, can have a diameter as low as about 5 microns on up to about 50 microns. A fiber manufactured with this particular feed forms a fiber suitable for processing in accordance with the present disclosure to thereby make the elastic pitch fiber of the present disclosure.

The fiber described above is next treated with specific processing steps to render the fiber infusible via oxidation. It is exposed to an oxidizing atmosphere of a sufficient amount of chlorine mixed with an inert gas (typically nitrogen) to increase the weight of the fiber to something in the range of about 15 percent to about 40 percent. This increase in weight is accomplished substantially at room temperature with chlorine. Other oxidants can be used and will provide different percent weight increases. In a typical and successful oxidation step, the gases (pure chlorine or with an inert gas) are flowed over and around the fiber at a gas flow velocity of perhaps 1 m/sec. The velocity is kept relatively, low to avoid physically disturbing the fiber because it is normally brittle at this stage of processing. This processing step is carried out typically at ambient temperature and ambient pressure. The oxidization atmosphere is delivered to the vicinity of the fiber for several minutes. This processing step can be extended from just a few minutes up to about one hour. Success has been obtained heretofore by continuing the oxidation step for 18 minutes in an atmosphere of about 5 to about 10 percent chlorine gas, the remainder of the gas being nitrogen. If multiple fibers are treated, and this would ordinarily be the case in the handling of fibers on a batch basis, some heat is liberated and, accordingly, the fibers cannot be packed too tightly. Excessive packing may create excessive heat on certain of the fibers which will be damaged at this stage of processing. Accordingly, the packing density is reduced or, alternatively, the gas in which this processing step is carried out is cooled slightly to assure that spot temperatures on the interior of the container do not rise significantly above the ambient level.

Specimen fibers (normally several fibers) can be tested to determine the percent weight increase The percent weight range, as mentioned above, is about 15 percent to about 40 percent. This range encompasses the optimum of about 20 percent weight increase These values are preferred where the oxidant is chlorine. Other oxidants can be used. It has been discovered that oxidation to about 40% by weight chlorine yields a fiber with less percent elongation for a given heat treatment temperature sequence than a fiber processed to about 20% by weight chlorine. Thus, a reduced percent oxidant generally defines a fiber which is more resilient with the same processing.

The next processing step involves dehydrohalogenation. This is accomplished in a heat treatment cycle. The oxidized fiber is next exposed to an atmosphere of inert gases and is heated. The inert gases preferably flow continuously around the fiber to carry off liberated gases from the fiber. The temperature of the fiber is raised. There is a limitation on the rate at which it can be raised. There is a type of annealing which occurs in this processing step. Accordingly, the fiber cannot be shocked by instant exposure to an elevated temperature. The temperature is therefore raised steadily. The actual temperature thus lags behind the partially and finally annealed maximum permissible temperature. As this is increased, the instantaneous permitted or maximum temperature will increase more rapidly, thereby enabling an increased rate of heating. It has been discovered that a reasonable rate of heating for the fiber of the present disclosure involves raising the temperature from ambient to about 100° C. in about one hour. Ambient is typically in the range of 20° to 25° C., and the increase to 100° C. at this rate then prepares the fiber for even further increase. The temperature is then increased at a rate of perhaps 25° C. per hour to a peak treatment temperature of about 500° C. The peak temperature is sustained for an interval ranging from just a few minutes upwards to about 24 hours.

Using a set of chlorinated fibers having an approximate 20 percent weight increase during the oxidation step, and accomplishing the dehydrohalogenation with the temperature increases to about 500° as described above, about half of the added weight is lost in this process. The percent weight loss is relatively independent of the duration at which the maximum temperature is sustained. If, for instance, the maximum temperature is obtained for just a few minutes or several hours, the percent weight loss is about the same. In this instance, the maximum temperature need not be determined with great precision. The peak temperature accomplished should be in the range of at least about 420°, the preferred peak being about 500° to 520°. Higher peak temperatures can be used but they do not seem to significantly further contribute to the percent elongation characteristics described for the present fiber. The heat treatment temperature profile may vary with a change in oxidant.

The fiber is cooled to room temperature in just a few minutes. Upon reaching room temperature, the fiber at this point can then be used in the manufacture of yarn by conventional spinning apparatus. At this juncture, the fiber will typically have, for fibers in the range of about 6 to about 15 microns diameter, a tensile strength up to about 22,000 psi with approximately 5 percent elongation. This defines a fiber having a Young's modulus of about $0.4\times10^6$psi. At this point, the fiber is suitable for use in spinning into yarn.

As an alternate subsequent step, fibers made in accordance with the process described above can be repetitively stretched. Stressing through an elongation less than maximum seems to increase the maximum elongation. In typical cycles, perhaps 3 to 10 cycles of stressing, the fibers can be pulled short of breaking to thereby increase the percent elongation. For instance, if the fibers are stressed to something on the order of 25 to 75 percent of maximum elongation as originally measured, after about 3 to about 10 cycles of stretching, the fibers then would show an increase percent elongation. If the original fibers have an elongation of about 5 percent to break, the stretching seems to increase the percent elongation to something in the range of about 6.1 to about 8.0 percent. Thus, this stretching step will be characterized as providing an additional about 20 to about 40 percent elongation to break. Regarding the number of stretch cycles 3 to 10 seems to gain some improvement. The fiber may benefit on applying a greater number of stretching cycles; however, increasing the number of stretch cycles indefinitely does not seem to greatly enhance fiber elongation over that obtained with just a few cycles of stretching.

The stretching sequence can be carried out by any suitable fiber stretching apparatus. An important factor to note is that there is no plastic flow upon such stretching. Rather, the fiber length is elastic (not plastic) as a result of the stretching process. The stretching process is able to obtain stretching without moving the zero point for stretching because there is no plastic flow.

An important factor to note from the foregoing is that it provides a fiber which has an elastic range but substantially no plastic range in its physical properties.

From the foregoing, it will be observed that alternate procedures can be used to provide fibers having an elongation of perhaps 4 percent, but typically 5 percent and sufficient to enable use with fiber spinning and yarn manufacturing equipment. With the post manufacture stretching step added, the change from about 5 percent to at least 6 and upwards of about 8 percent yields what is cautiously defined as about 20 to about 40 percent additional elongation.

Important additional physical properties of the completed fiber include heat resistance to a significant high value, perhaps in excess of 1,500° C. and likely as high as 2,500° C. Additional important factors include the fact that a fiber is impervious to most chemicals and is substantially inert in use. It is not easily broken and can otherwise bend, flex and tolerate substantial physical abuse in application.

While the foregoing is directed to the preferred embodiment, the scope thereof is determined by the claims which follow.

What is claimed is:

1. A method of making a carbon fiber having enhanced elongation to break, comprising the steps of:

(a) melt spinning an isotropic fiber through a selected size opening, the melt spinning step utilizing a pitch characterized by having essentially no optically visible anisotropic pitch in an otherwise isotropic pitch, the pitch having less than about 1 percent quinoline insoluble portion, a softening point in the range of about 130° C. to about 300° C., and a Conradson number of 50 or more;

(b) oxidizing the pitch fiber in an oxidant atmosphere until the fiber increases in weight by a specific amount of the oxidant;

(c) removing oxidant from the fiber in the presence of heat up to a temperature and for an interval sufficient to reduce the weight by a specific amount to obtain a fiber having at least 2 percent elongation to break; and thereafter (d) repetitively stretching the fiber in the elastic range to thereby increase the percent elongation to break by at least about 20 percent.

2. The method of claim 1 wherein the oxidant is chlorine and wherein the oxidizing step is conducted at ambient temperatures for a time of up to about one hour to add about 15 to about 40 percent of the original weight to the fiber.

3. The method of claim 2 wherein the chlorine is mixed with an inert gas and the oxidizing step continues until the fiber is at least about 20 percent by weight chloride.

4. The method of claim 2 wherein the step of removing weight is by dehydrohalogenation and the temperature thereof is increased at a limited rate from the initial beginning temperature and wherein the weight reduction is at least about 10%.

5. The method of claim 4, wherein the temperature is increased from ambient up to a specified maximum temperature at a rate so that the actual temperature does not exceed the temperature at which the fiber is damaged.

6. The method of claim 5 wherein the temperature is increased to obtain a maximum temperature of at least about 420° C.

7. The method of claim 6 wherein the temperature is increased to obtain a maximum temperature of at least about 500° C. to about 520° C.

8. The method of claim 1 wherein the step of stretching the fiber is carried out for at least about 3 cycles of stretching and wherein the stretching is in the range of about 25 to about 75 percent of the elongation at which breakage occurs.

9. The method of claim 1 wherein the step of stretching includes about 3 to about 10 cycles of stretching and the elongation to break is increased by at least about 20 to about 40 percent.

* * * * *